US008744305B2

(12) United States Patent
Niikawa

(10) Patent No.: US 8,744,305 B2
(45) Date of Patent: Jun. 3, 2014

(54) IMAGE FORMING APPARATUS WITH LATCH FOR OPENABLE COVER

(75) Inventor: Yusuke Niikawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 965 days.

(21) Appl. No.: 12/795,145

(22) Filed: Jun. 7, 2010

(65) Prior Publication Data

US 2010/0315658 A1 Dec. 16, 2010

(30) Foreign Application Priority Data

Jun. 12, 2009 (JP) ..... 2009-141082

(51) Int. Cl.
*G03G 15/00* (2006.01)
*G03G 15/22* (2006.01)
*G03G 21/16* (2006.01)

(52) U.S. Cl.
USPC ..... 399/110; 399/125; 399/151

(58) Field of Classification Search
USPC ..... 399/110, 113, 124, 125, 401, 151, 107, 399/114
See application file for complete search history.

(56) References Cited

U.S. PATENT DOCUMENTS 7,133,626 B2 * 11/2006 Kaiga et al. ..... 399/110
7,561,825 B2 * 7/2009 Hirose et al. ..... 399/110
2007/0047028 A1 * 3/2007 Hashimoto et al. ..... 358/498

FOREIGN PATENT DOCUMENTS

JP 2009108617 A * 5/2009
JP 2005-189552 7/2010

* cited by examiner

*Primary Examiner* — Clayton E Laballe
*Assistant Examiner* — Victor Verbitsky
(74) *Attorney, Agent, or Firm* — Fitzpatrick, Cella, Harper & Scinto

(57) ABSTRACT

An image forming apparatus includes an image forming portion for forming an image on a recording material; an image reading portion, for reading an original image, movable between a first position in which the image reading portion opposes the image forming portion and a second position in which the image reading portion is partly raised from the image forming portion; an openable member movable, relative to the image forming portion independently of the image reading portion, between an open position in which the openable member exposes an inside of the image forming portion and a closed position in which the openable member covers the image forming member; and preventing means capable of preventing movement of the openable member toward the closed position when the image reading member is located at the second position. The prevention of movement of the openable member is released by moving the image reading member toward the first position from the second position in which the preventing means prevents the movement of the openable member.

9 Claims, 10 Drawing Sheets

(a)

(b)

(a)

(b)

(a)

(b)

IMAGE FORMING APPARATUS WITH LATCH FOR OPENABLE COVER

FIELD OF THE INVENTION AND RELATED ART

The present invention relates to an image forming apparatus particularly suitable for a copying machine including an image reading portion above an image forming portion.

The copying machine including the image reading portion above the image forming portion and including a recording material discharge space, between the image forming portion and the image reading portion, in which a recording material is to be discharged has been known. Such a copying machine is generally constituted so that the inside of the image forming portion can be exposed in order to perform trouble shooting at the image forming portion or maintenance such as cleaning of the inside of the image forming portion or exchange of consumable parts. A constitution and operation for exposing the inside of the image forming portion in a conventional copying machine will be described. At the image forming portion, a door (openable member) rotationally moved (rotated) upward relative to the image forming portion in order to expose the inside of the image forming portion is provided, and this door is disposed at an upper portion of the image forming portion due to constraints of arrangement of various constitutional elements at the image forming portion. Further, the image reading portion is disposed above the image forming portion through the recording material discharge space located between the image reading portion and the image forming portion and is provided rotatably upward so as to face and expose the image forming portion. Therefore, when a maintenance operation of the inside of the image forming apparatus is performed, there is need to prevent the inside of the image forming portion from being covered by rotating the door and the image reading portion to keep the inside of the image forming portion in an exposed state. Japanese Laid-Open Patent Application (JP-A) 2005-189552 discloses such a preventing mechanism that the door and the image reading portion are constituted so as to be rotated in interrelation with each other by a link member so that the inside of the image forming portion is kept in the exposed state and is not covered. However, the mechanism for interrelating the rotations of the door and the image reading portion is complicated, so that the image forming apparatus is increased in size and cost.

Therefore, an image forming apparatus constituted as shown in FIGS. 7(*a*) and 7(*b*) can be assumed. FIGS. 7(*a*) and 7(*b*) are schematic views for illustrating the rotation of an image reading portion 170 and a door 172. Specifically, FIG. 7(*a*) shows a state in which the image reading portion 170 and the door 172 are not rotated. FIG. 7(*b*) shows a state in which the image reading portion 170 and the door 172 are rotated and opened relative to the image forming portion. In this image forming apparatus, the door 172 and the image reading portion 170 are not interrelated with each other, so that the image forming apparatus includes a simpler mechanism than that in the case of interrelating the door 170 with the image reading portion 172. The image reading portion 170 is rotated by an unshown link mechanism to be held in a partly raised state relative to the image forming portion so as not to face the image forming portion. On the image reading portion 180 and the door 172, magnets 174 and 175 are provided. For this reason, by contact of the magnet 175 on the door 172 with the magnet 174 on the image reading portion 170 held so as not to face the image forming portion, the door 172 is held by the image reading portion 170 and is prevent from being closed.

From the viewpoint of usability, it is desirable that a user can close the door 172 and the image reading portion 170 by rotating the image reading portion from the state in which the door 172 is held and prevented from being closed by the image reading portion 170. However, in the mechanism shown in FIGS. 7(*a*) and 7(*b*), a common rotation shaft 171 is used for the image reading portion 170 and the door 172, so that it is possible to prevent the door 172 from being closed by keeping the door 172 in the open state even when the image reading portion 170 is located at any position. Therefore, even when the user holds and rotates the image reading portion 170 from the state in which the door 172 is held and prevented from being closed by the image reading portion 170, the door 172 is still kept in the holding state by the image reading portion 170, so that the door 172 cannot be closed.

SUMMARY OF THE INVENTION

The present invention has been accomplished in view of the above-described problem.

A principal object of the present invention is to provide an image forming apparatus capable of closing not only an image reading portion but also a door, with a simple constitution, from a state in which the image reading portion prevents the door for exposing an inside of an image forming portion from being rotated in a door closing direction.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

With reference to the drawings, embodiments of the present invention will be described in detail. However, dimensions, materials, shapes and relative arrangements of constituent elements in the present invention are not limited to those described in the following embodiments since they should be appropriately be changed depending on apparatuses to which the present invention is applicable and depending on various conditions.

[Embodiment 1]

Figure 1:
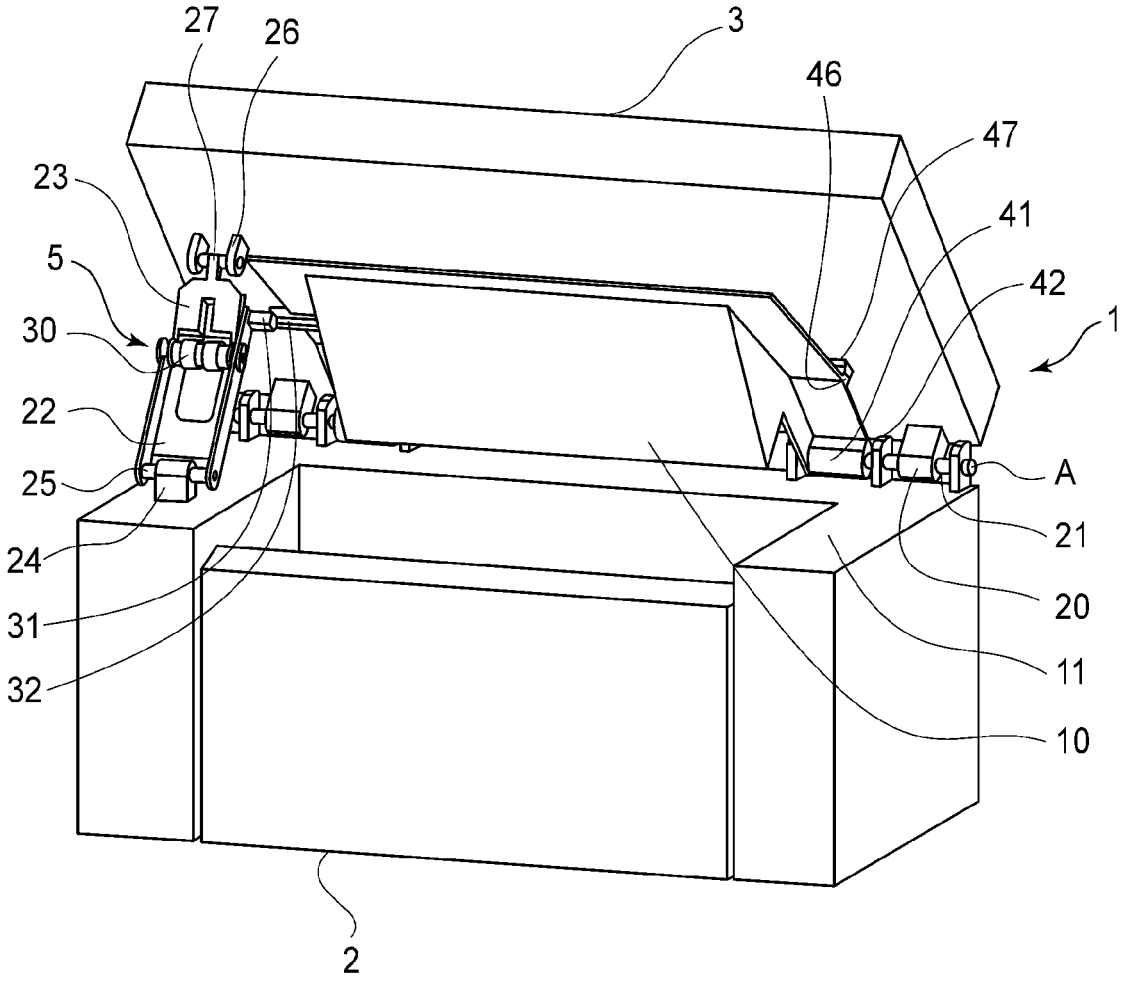
FIG. 1 is a schematic view of an image forming apparatus in Embodiment 1 of the present invention.
Figure 2:
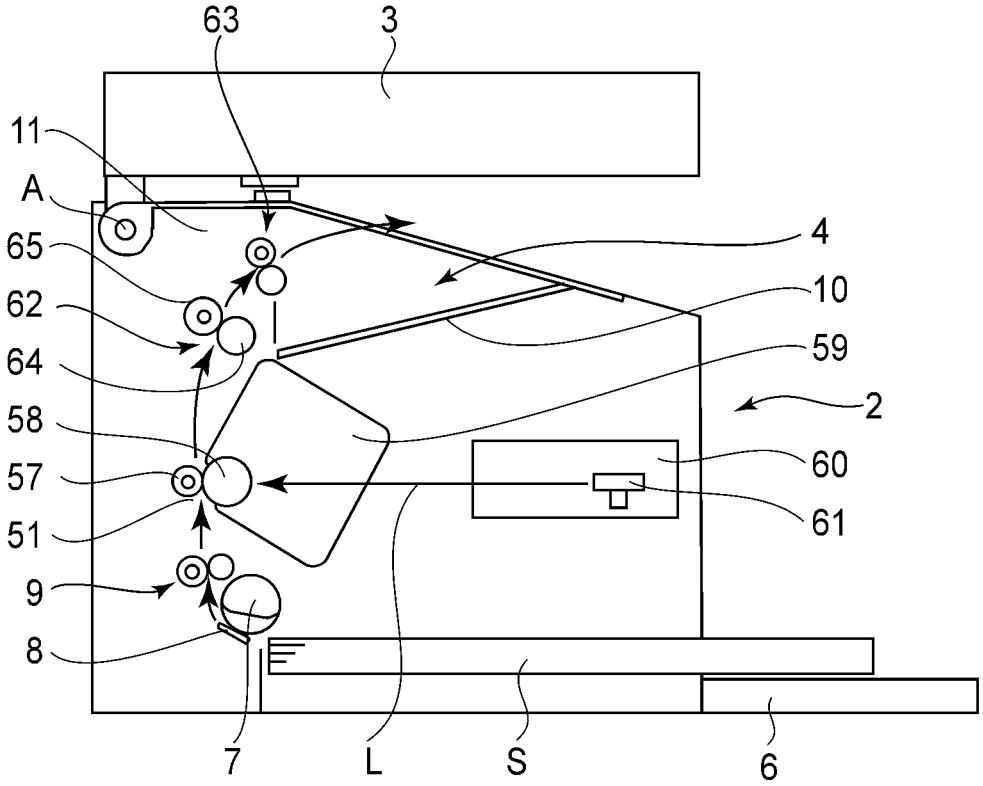
FIG. 2 is a schematic view showing an inner structure of the image forming apparatus in Embodiment 1.

The image forming apparatus in this embodiment according to the present invention will be described with reference to FIGS. 1 and 2. FIG. 1 is a schematic view of the image forming apparatus in this embodiment. FIG. 2 is a schematic view showing an inner structure of the image forming apparatus in this embodiment.

As shown in FIG. 1, an image forming apparatus 1 in this embodiment includes a printer portion 2 as an image forming portion capable of forming an image on a recording material and includes a scanner portion 3 as an image reading portion capable of reading an original image. The image forming apparatus 1 is a multi-function machine capable of functioning not only as a printer and a copying machine but also as a scanner. That is, the image forming apparatus 1 can form an image at the portion 2 depending on image information from external equipment such as a host computer communicatably connected thereto or depending on original image information read by the scanner portion 3. Further, the image forming apparatus 1 can also send the original image information read by the scanner portion 3 to the external equipment communicatably connected thereto. As shown in FIG. 2, the scanner portion 3 is located above the printer portion 2 and is disposed in a state in which the scanner portion 3 and the printer portion 2 sandwich a recording material discharge space. Further, the scanner portion 3 is attached to the printer portion 2 so as to be rotatable about a rotation center shaft (axis) A provided at a rear portion. By rotating the scanner portion 3 about the rotation center shaft A, the scanner portion 3 can be moved to an open (partly raised) position and a closed (facing) door with respect to the printer portion 2. At a front portion of the image forming apparatus 1, a link member 5 for connecting the printer portion 2 and the scanner portion 3 with each other is provided. The scanner portion 3 is openably (rotatably) shaft-supported by the printer portion 2 so that a recording material discharge space for a recording material S can be exposed and enlarged and an inner exposed area of the printer portion 2 can be enlarged. The printer portion 2 is a laser beam printer for recording an image on the recording material S such as recording paper in accordance with an electrophotographic method. The printer portion 2 generally forms the image by the following constitution and function.

The recording material S stacked in a sheet feeding tray 6 is separated and fed one by one by a sheet feeding roller 7 and a sheet separating means 8 on the basis of a print signal from a host computer (not shown). The separated recording material S is conveyed to a transfer portion 51. The transfer portion 51 includes a process cartridge 59 which is formed as a unit and is detachably mountable to the printer portion 2, i.e., the image forming apparatus 1 and includes a transfer roller 57 and the like. The process cartridge 59 is constituted by a photosensitive drum 58, a charger for electrically charged the photosensitive drum 58, a developing device for developing a latent image on the photosensitive drum 58 with toner, a cleaner for removing and collecting residual toner on the photosensitive drum 58, and the like. A laser scanner unit 60 is constituted by integrally supporting a polygonal mirror 61, a polygonal mirror rotating motor, a laser unit, and the like as a unit. Laser light L is emitted from the laser scanner unit 60 on the basis of the image information, and the surface of the photosensitive drum 58 is exposed to the laser light L, so that the latent image is formed on the photosensitive drum 58 in accordance with the electrophotographic method. This latent image is developed with the toner as a developer by a developing means. The developed toner image is transferred from the photosensitive drum 58 onto the conveyed recording material S by the transfer roller 57. Thereafter, the photosensitive drum 58 is cleaned by the cleaner by removing the residual toner from the photosensitive drum 58. The recording material S after completion of the toner image transfer is conveyed into a fixing unit 62 constituted by a fixing film 64 and a pressing roller 65 pressed against the fixing film 64, so that the transferred toner image is heat-fixed in the fixing unit 62. The recording material S on which the tone image is fixed is conveyed by a sheet discharge roller pair 63 and is discharged in a recording material discharge space 4 at an upper portion of the printer portion 2.

The recording material discharge space 4 is provided on the upper surface of the door (openable member) 10, as a part of a casing of the printer portion 2. That is, the door 10 includes a stacking surface for stacking the recording material S and between the stacking surface and the scanner portion 3, a space for permitting discharge and stacking of recording sheets as the recording material S is created. Further, the door 10 is shaft-supported, by a frame 11 of the photosensitive drum 2, rotatably and openably about a rotation center shaft coaxially with the rotation center shaft A of the scanner portion 3. The door 10 is rotatable independently of the scanner portion 3 and is movable between an open position in which the door 10 is opened with respect to the printer portion 2 and a closed position in which the door 10 is closed. By rotating the door 10 with respect to the printer portion 2, the door 10 is located at the open position, so that the inside of the printer portion 2 can be exposed and therefore access to the process cartridge 59 and jam clearance of the recording material S are enabled.

The scanner portion 3 is a known (conventional) flat-head scanner. Inside structure and function of the scanner portion 3 are the same as those of the conventional flat-head scanner, thus being omitted from description.

Figure 4:
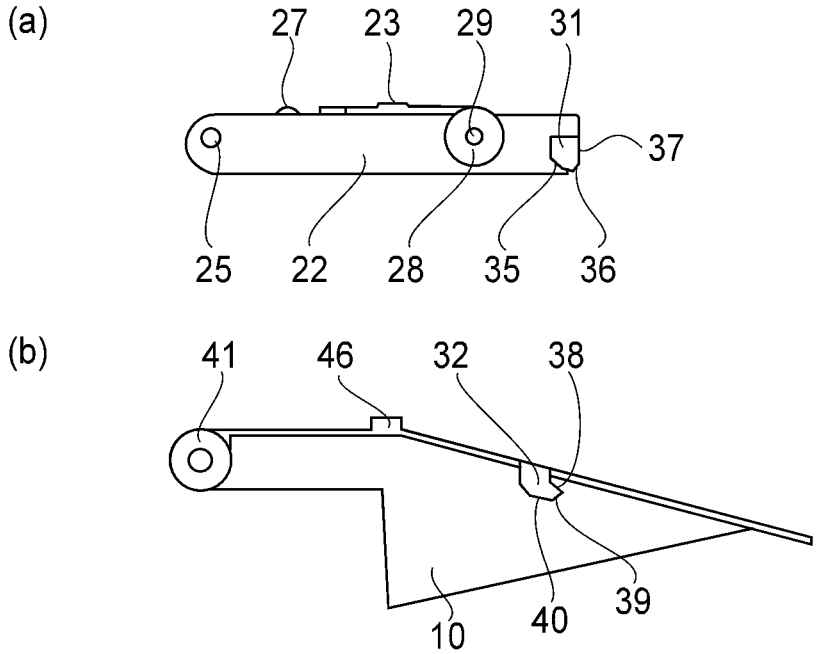
FIGS. 4(*a*) and 4(*b*) are detailed views showing a link member and the door in Embodiment 1.
Figure 3:
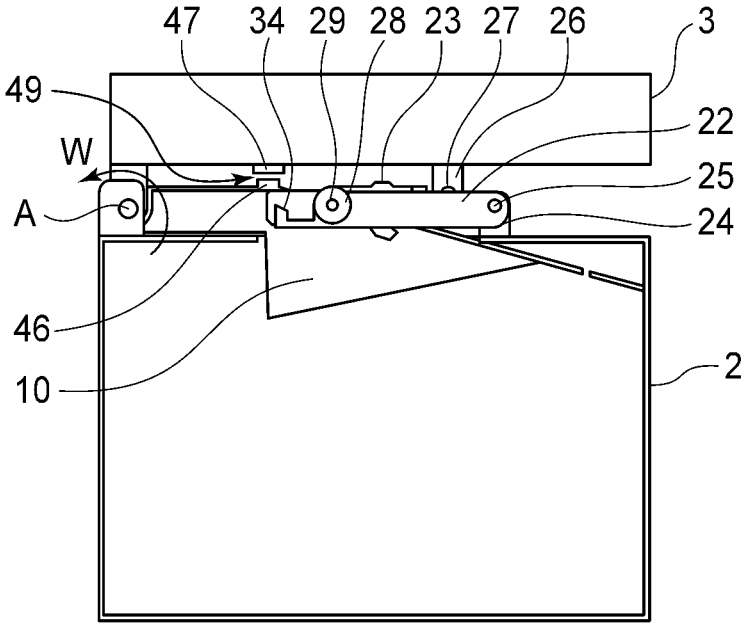
FIGS. 3(*a*) and 3(*b*) are schematic views for illustrating an opening and closing operation of a scanner portion and a door in the image forming apparatus in Embodiment 1.
Figure 3:
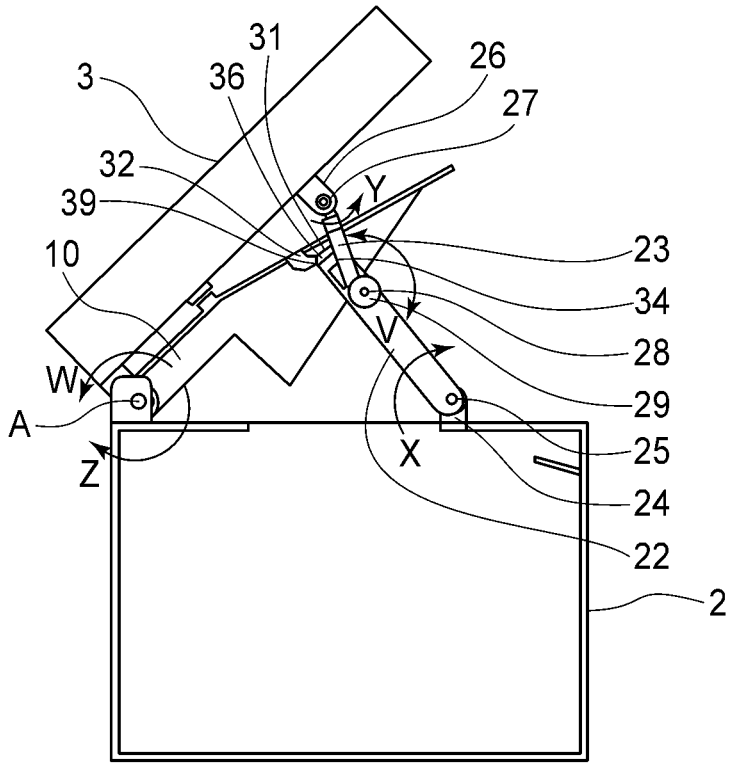

With reference to FIG. 3 to FIG. 5E, a rotation (open/close) mechanism for the scanner portion 3 and the door 10 will be described. FIGS. 3(*a*) and 3(*b*) are schematic views for illustrating an opening and closing operation of the scanner portion and the door in the image forming apparatus in this embodiment, wherein FIG. 3(*a*) shows a state in which the scanner portion and the door are opened and FIG. 3(*b*) shows a state in which the scanner portion and the door are closed. FIG. 4(*a*) is a detailed view of a link member in this embodiment, and FIG. 4(*b*) is a detailed view of the door in this embodiment. FIGS. 5A to 5E are detailed views each showing a door holding portion in this embodiment.

As shown in FIG. 1 and FIGS. 3(*a*) and 3(*b*), at a rear and lower portion of the scanner portion 3, a scanner rotation supporting portion 20 is provided. Further, the scanner portion 3 is rotatably attached to the printer portion 2 by a scanner rotation holding portion 21 as a part of the frame 11 of the printer portion 2, with the rotation center shaft A as a supporting shaft. The scanner rotation supporting portion 20 and the scanner rotation holding portion 21 are provided at both rear and lower end portions of the scanner portion 3 with respect to a rotation shaft direction. Behind the door 10, a door rotation supporting portion 41 is provided. The door 10 is rotatably provided by a door rotation holding portion 42 as a part of the frame 11 of the printer portion 2, with the rotation center shaft A as a supporting shaft. The door rotation supporting portion 41 and the door rotation holding portion 42 area provided at both rear and lower end portions of the door 10. On the door 10 and the scanner portion 3, abutment surfaces 46 and 47 capable of abutting against each other are provided, respectively. In a state in which the door 10 and the scanner portion 3 are closed, between the abutment surfaces 46 and 47, a gap 49 is ensured.

The printer portion 2 and the scanner portion 3 are connected by the link member 5. The link member is principally constituted by a lower link 22, an upper link 23, and a torsion coil spring 30. The lower link 22 is rotatably supported, at a lower link rotation supporting portion 25, by a lower link rotation holding portion 24 provided on the frame 11 of the printer portion 2. The upper link 23 is rotatably supported, as an upper link rotation supporting portion 27, by an upper link rotation holding portion 26 provided at a lower portion of the scanner portion 3. These lower link 22 and upper link 23 are rotatably connected to a lower link connecting portion 28 on a supporting portion side and an upper link connecting portion 29 on an opposite side, respectively. The lower link connecting portion 28 is disposed on the scanner rotation holding portion 21 side with respect to the lower link rotation supporting portion 25. By connecting the lower link 22 and the upper link 23 in the above-described manner, the lower surface of the scanner portion 3, the frame 11 of the printer portion 2, the lower link 23 and the upper link 23 are rotatably supported at associated ones of the rotation supporting portions, thus constituting a quadric link.

The torsion coil spring 30 is attached so as to urge the lower link 22 and the upper link 23 in a direction indicated by an arrow V, with the lower link connecting portion 28 and the upper link connecting portion as a shaft axis. For that reason, relative to the lower link 22, the upper link 23 receives, from the torsion coil spring 30, a force for rotating the upper link 23 in the direction V about the upper link connecting portion 29 due to the urging force by the torsion coil spring 30. Therefore, in order that the upper link 23 is not rotated relative to the lower link 23 by a predetermined amount (angle) or more, an abutment surface 34 functioning as a rotation stopper for the upper link 23 is provided on the lower link 22. By this link mechanism, the scanner portion 3 is rotated relative to the printer portion 2 and is held in a state in which the recording material discharge space is enlarged. Further, at an end portion of the lower link 22 opposite from the lower link rotation supporting portion 25, a projection 31 (first projection) projecting toward the door 10 is provided. Further, on a side surface of the door 10 on the lower link 22 side, a projection 32 (second projection) projecting toward the lower link 2 is provided.

As shown in FIGS. 4(*a*) and 4(*b*), the projection 31 of the lower link has surfaces 35, 36 and 37, and the projection 32 of the door 10 has surfaces 38, 39 and 40. Incidentally, as shown in FIG. 3(*b*), when the scanner portion 3 is kept in the open state (partly raised state), the projection 32 of the door 10 is disposed at a position in which the surface 39 of the projection 32 of the door 10 contacts the surface 36 of the projection 31 of the lower link 22 to keep the door 10 in the open state. Details will be described later.

Next, the rotation (opening and closing) operation of the scanner portion 3 and the door 10 will be described. As shown in FIG. 3(*a*), during a normal operation, the scanner portion 3 is placed in the closed state (facing state) relative to the printer portion 2. Further, in the case where, the inside of the printer portion 2 is exposed for the access to the process cartridge 59 or the jam clearance of the recording material S, first, the scanner portion 3 is usually raised and is held by the link mechanism in the open state (partly raised state). Thereafter, the door 10 is raised and held in the open state.

The operation for raising the scanner portion 3 and holding the scanner portion 3 in the open state by the link mechanism will be described. When the end of the scanner portion 3 opposite from the scanner rotation supporting portion 20 is raised from the position (first position) in which the scanner portion 3 faces the printer portion 2, the scanner portion 3 is rotated in a direction indicated by an arrow W about the rotation center shaft A. At this time, the scanner portion 3, the frame of the printer portion 2, the lower link 22 and the upper link 23 constitute the quadric link. For this reason, by the rotation operation of the scanner portion 3, the lower link 22 is rotated about the lower link rotation supporting portion 25 along a predetermined locus in a direction indicated by an arrow X. On the other hand, the upper link 23 is rotated about the upper link rotation supporting portion 27 relative to the scanner portion 3 along a predetermined locus in a direction indicated by an arrow Y. Then, as shown in FIG. 3(*b*), when the lower link 22 and the upper link 23 are rotated by predetermined amounts (angles), the upper link 23 abuts against the abutment surface 34 provided on the lower link 22, the motion of the quadric link is stopped. At this time, the scanner portion 3 is located at a predetermined open position (second position) in which the scanner portion 3 is partly raised from the first position with respect to the printer portion 2. When the scanner portion 3 is further raised from the open position in the direction W, the lower link 22 and the upper link 23 abut against each other, so that the scanner portion 3 is placed in a state in which it cannot be raised in the direction W. Further, when the scanner portion 3 is placed in the open position at the scanner portion 3, a force for closing (lowering) the scanner portion 3 by a self weight of the scanner portion 3 is generated. However, by the torsion coil spring 30 attached to the link member 5, a force for opening the lower link 22 and the upper link 23 is exerted in the direction V so as to stretch (open) the lower link 22 and the upper link 23, so that the open state of the scanner portion 3 is kept. A shape, the position and the like of the magnet 5 are determined depending on conditions such as the weight of the scanner portion 3, a position in which the scanner portion 3 is in a desired open state, and an operating force for raising the scanner portion 3. The open position (second position) in which the scanner portion 3 is held in the open state may also be set at a position in which the lower link 22 and the upper link 23 are somewhat rotated (closed) from the position in which the lower link 22 and the upper link 23 abut against each other. That is, in this case, the scanner portion 3 can be somewhat opened (raised) from the open position in the direction W.

Next, an operation for keeping the door 10 in the open state will be described. FIGS. 5A to 5E are detailed views of the door 10, the lower link 22 and the scanner portion 3 when the door 10 is kept in the open state. However, when these figures are viewed from the same such as in FIG. 3(*b*), the projection 31 is hidden behind the lower link 22. For this reason, in FIGS. 5A and 5B, the lower link 22 and the upper link 23 are indicated by a broken line and the projection 31 is indicated by a solid line. In FIGS. 5C, 5D and 5E, lower link 22 and the upper link 23 are omitted for the sake of simplicity and the projection 31 is indicated by the solid line.

In the case where the scanner portion 3 is held in the open state, when the end of the door 10 opposite from the side on which the door rotation supporting portion 41 is disposed is raised, the door 10 is rotated about the rotation center shaft A in the direction W. By the rotation of the door 10, the projection 32 of the door 10 is rotated along a locus 43 in the direction W.

Figure 5A:
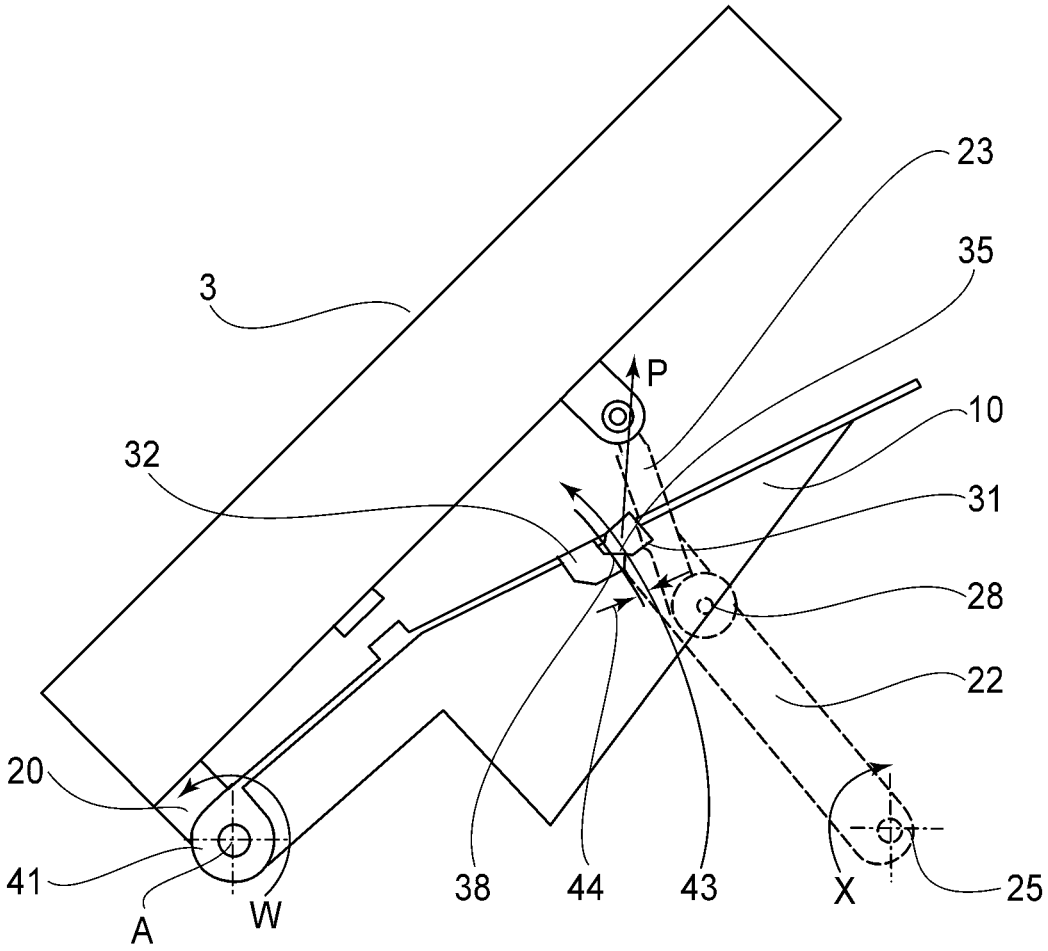
FIGS. 5A to 5E are detailed views showing a door holding portion in Embodiment 1.

As shown in FIG. 5A, when the projection 32 of the door 10 is rotated by the predetermined amount (angle), the surface 38 of the projection 32 of the door 10 contacts the surface 35 of the projection 31 of the lower link 22. From this state, by further rotating the door 10 in the direction W, the surface 35 is pushed by the surface 38. Here, the surfaces 35 and 38 are formed to have a direction of an oblique surface (a slope of the surface) so that the lower link 22 and the door 10 extend in their escape direction with respect to the movement direction W of the locus 43. Therefore, correspondingly to an amount 44 of overlapping between the projection 32 of the door 10 and the projection 31 of the lower link 22 with respect to the movement direction W of the locus 43, the lower link 22 and door 10 are bent and moved away.

Figure 5B:
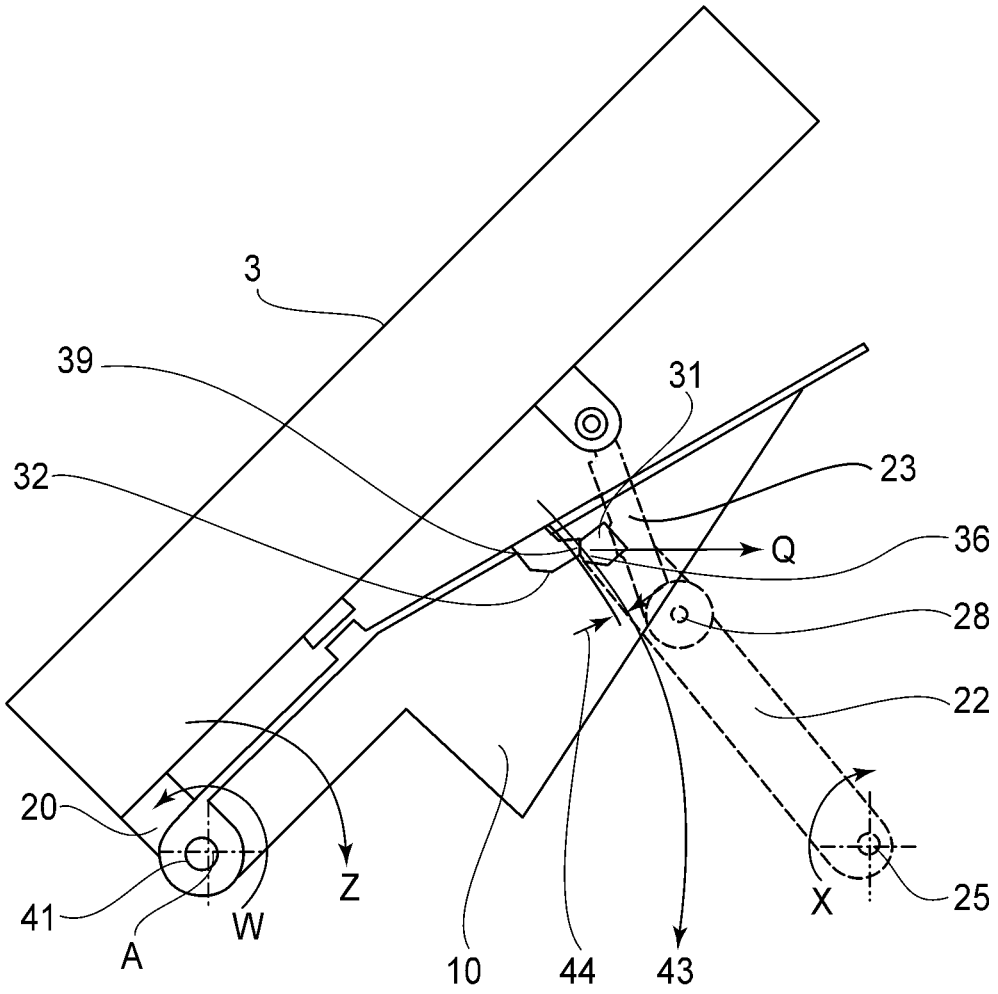
Figure 5C:
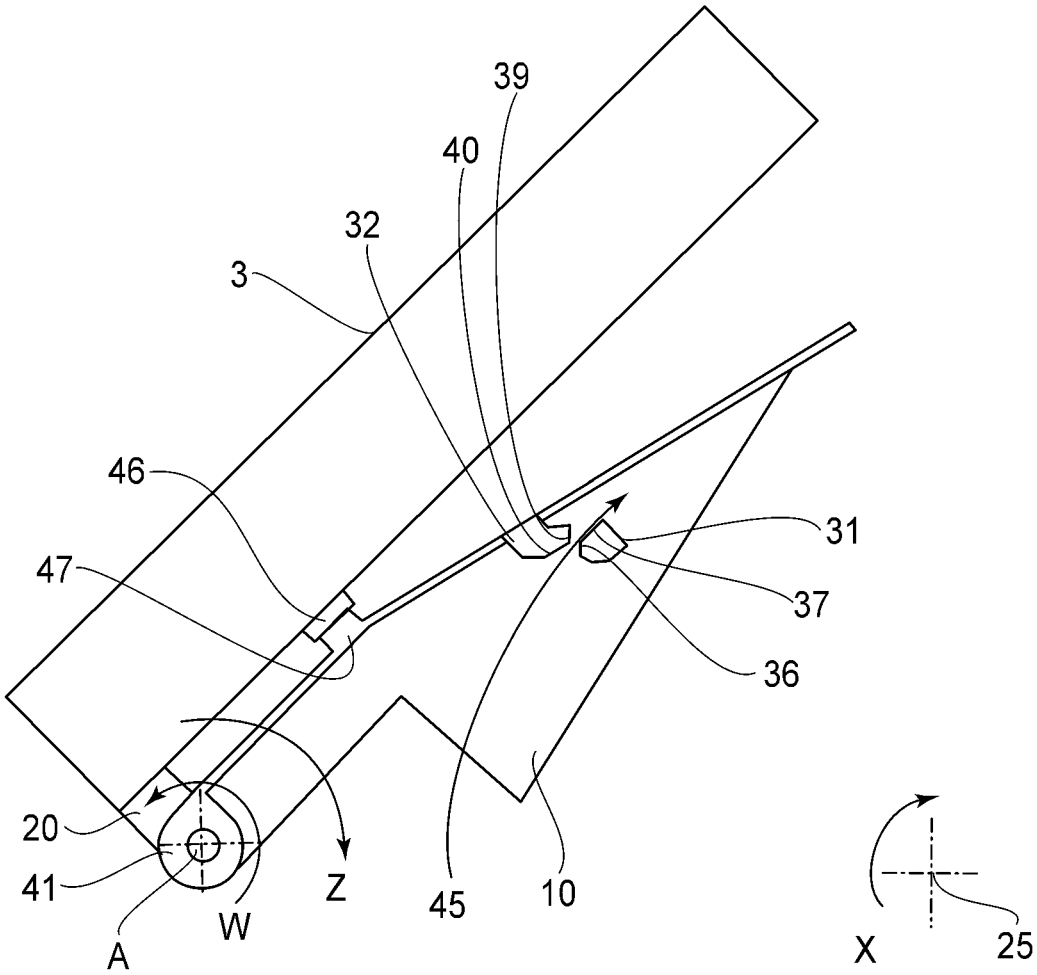
Figure 5D:
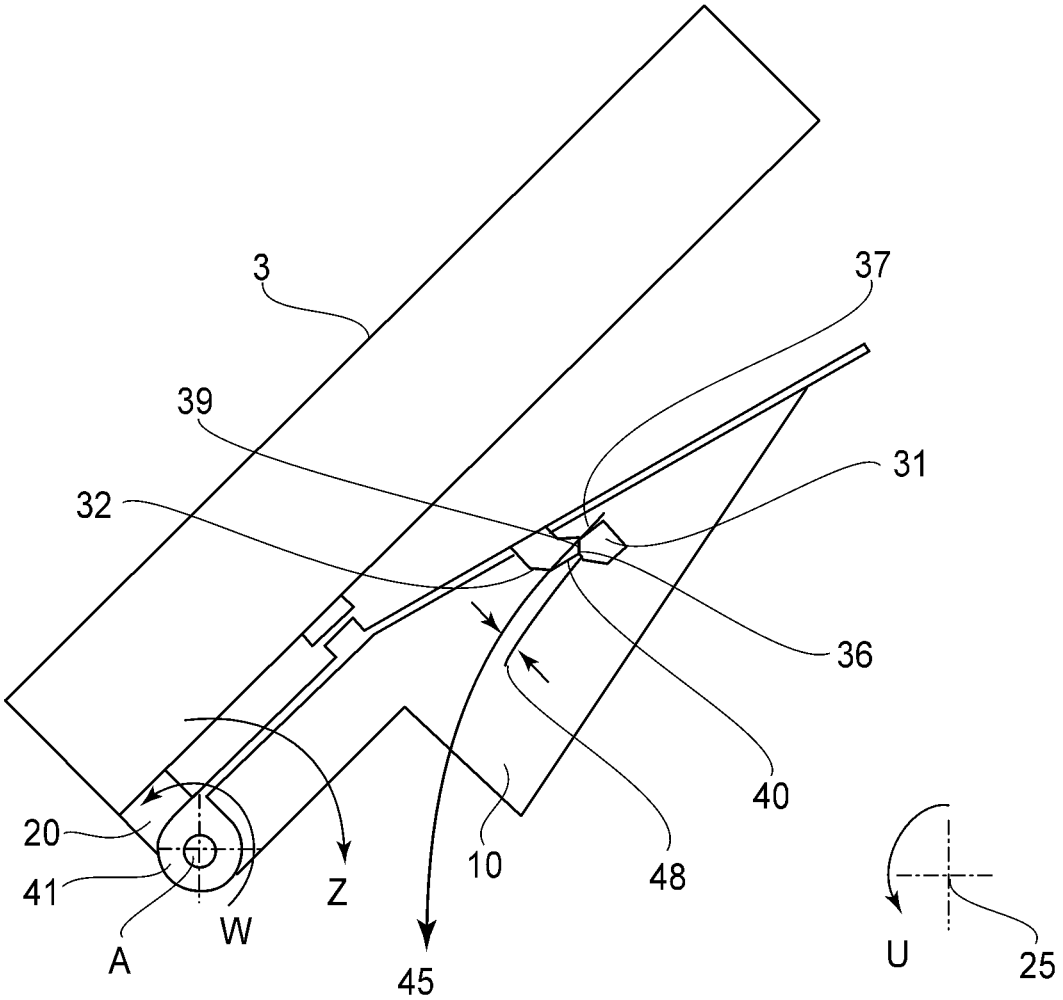
Figure 5E:
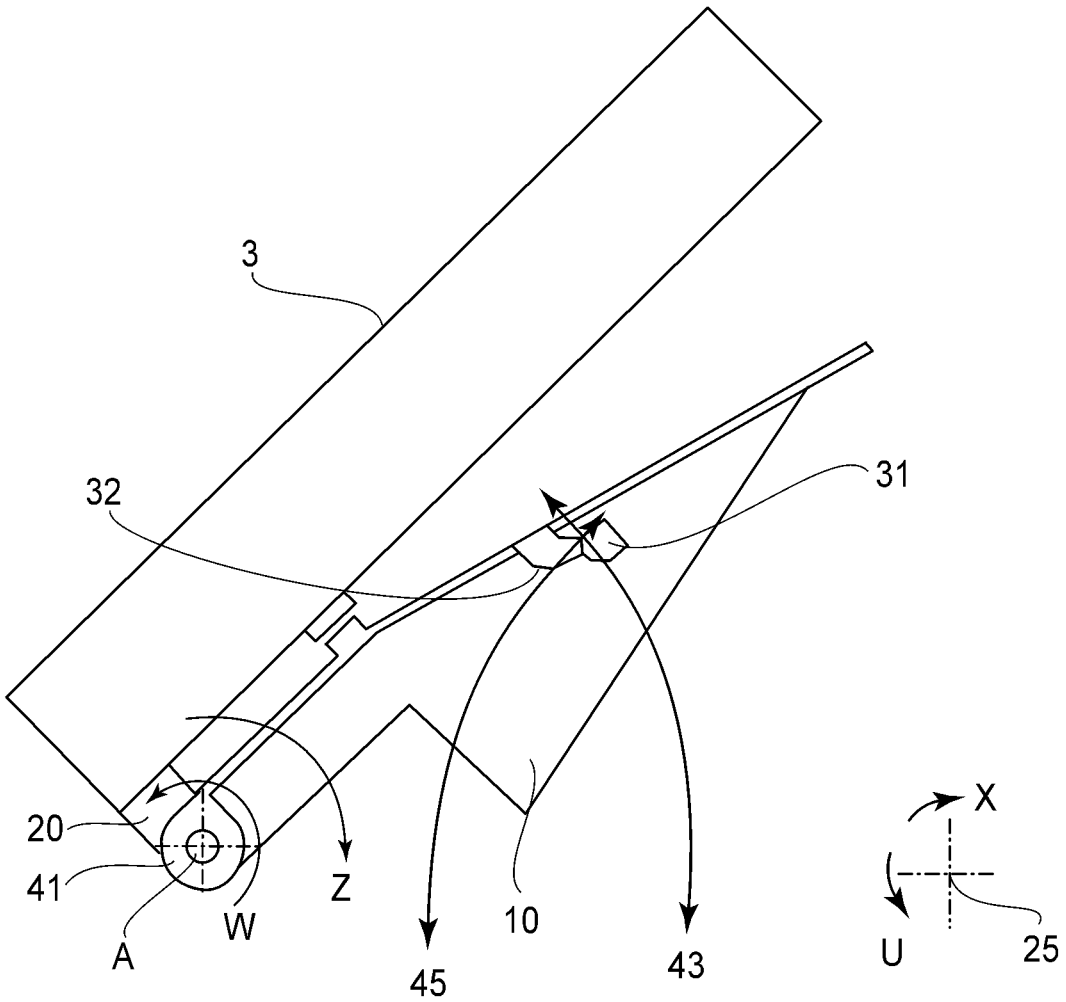

As shown in FIG. 5B, when the surface 38 gets over the surface 35, a closing force of the door 10 by the self weight of the door 10 is received by the surface 36 of the lower link 22 by contact of the surface 36 with the surface 39 of the door 10. That is, in this state, the projection 32 as the portion to be prevented is prevented from rotating by the projection 31 as the preventing portion, so that the door 10 is in a state in which the door 10 is prevented from rotating in the door 10 closing direction. Hereinafter, the state in which the door 10 is prevented from rotating in the door 10 closing direction is referred to as a hold state (holding). At this time, the door 10 is located at a open state position (a predetermined open position). As a result, the user can access to the inside of the printer portion 2.

In the case where the surface 38 gets over the surface 35, when the surface 35 of the projection 31 of the lower link 22 is pushed by the projection 32 of the door 10, the lower link 22 receives a force from the door 10 with respect to a direction indicated by an arrow P. The force with respect to the direction P generates moment with respect to the direction X by which the lower link 22 is opened relative to the lower link rotation supporting portion 25. Then, by the X direction moment of the lower link 22, the scanner portion 3 receives a force with respect to the direction W, i.e., the open direction thereof. Therefore, there is no possibility that the scanner portion 3 is closed by the P direction force applied from the door 10 to the lower link 22 for holding the door 10 in the open state. Further, when the surface 36 of the lower link 22 (the projection 31) contacts the surface 39 of the door 10 (the projection 32) to hold the door 10 in the open state, the lower link 22 receives the force from the door 10 with respect to a direction indicated by an arrow Q. This Q direction force also generates the X direction moment by which the lower link 22 is opened relative to the lower link rotation supporting portion 25, so that the scanner portion 3 receives a force with respect to the direction W, i.e., the open direction. Therefore, there is no possibility that the scanner portion 3 is closed similarly also when the door 10 is held in the open state.

Next, the access to the inside of the printer portion 2 is completed and in order to return the image forming apparatus 1 to the normal operation state, the door 10 is usually closed first and then the scanner portion 3 is closed. This operation will be described.

First, the closing operation of the door 10 will be described. In the open state of the door 10, the door 10 is held in the open state by the contact of the surface 36 of the lower link 22 with the surface 39 of the door 10. In this state, in order to close the door 10, the end of the door 10 opposite from the door rotation supporting portion 41 side is pushed down. As a result, as shown in FIG. 5B, the door 10 is rotated about the rotation center shaft A in a direction indicated by an arrow Z, so that the surface 39 of the projection 32 of the door 10 pushes the surface 36 of the projection 31 of the lower link 22. Here, the surfaces 39 and 36 are formed to have a direction of an oblique surface (a slope of the surface) so that the lower link 22 and the door 10 extend in their escape direction with respect to the movement direction Z of the locus 43. Therefore, correspondingly to the amount 44 of overlapping between the projection 32 of the door 10 and the projection 31 of the lower link 22 with respect to the movement direction Z of the locus 43, the lower link 22 and door 10 are bent and moved away. Then, when the surface 39 gets over the surface 36, the prevention of the door 10 from rotating in the closing direction is released, so that the door 10 is further rotated and closed in the direction Z. The direction, shape, overlapping amount 44 and the like of the oblique surface of the surfaces 39 and 38 are determined so as to satisfy conditions such that the door 10 can be held against the self weight of the door 10 with an allowance and that the lower link 22 and the door 10 are bent and moved away with a good operating force when the door 10 is closed.

Next, the closing operation of the scanner portion 3 will be described. The end of the scanner portion 3 opposite from the scanner rotation supporting portion 20 side is pushed down, so that a force exceeding a force for holding the scanner portion 3 by the torsion coil spring 30 attached to the link member 5 is exerted on the scanner portion 3. As a result, the scanner portion 3 is rotated about the rotation center shaft A in the direction Z, thus being closed.

In the above description of the rotation (opening and closing) operation of the scanner portion 3 and the door 10, in the case where the inside of the printer portion 2 is exposed, the scanner portion 3 is raised and held in the open state and then the door 10 is raised and held in the open state. Further, when the image forming apparatus 1 is returned to the normal operation state, the door 10 is closed and then the scanner portion 3 is closed. However, an operation for raising the door 10 in the closed state of the scanner portion 3 when the inside of the printer portion 2 is exposed and an operation for closing the scanner portion 3 while keeping the door 10 in the open state when the image forming apparatus 1 is returned to the normal operation state can be considered. These two operations will be described.

Figure 7:
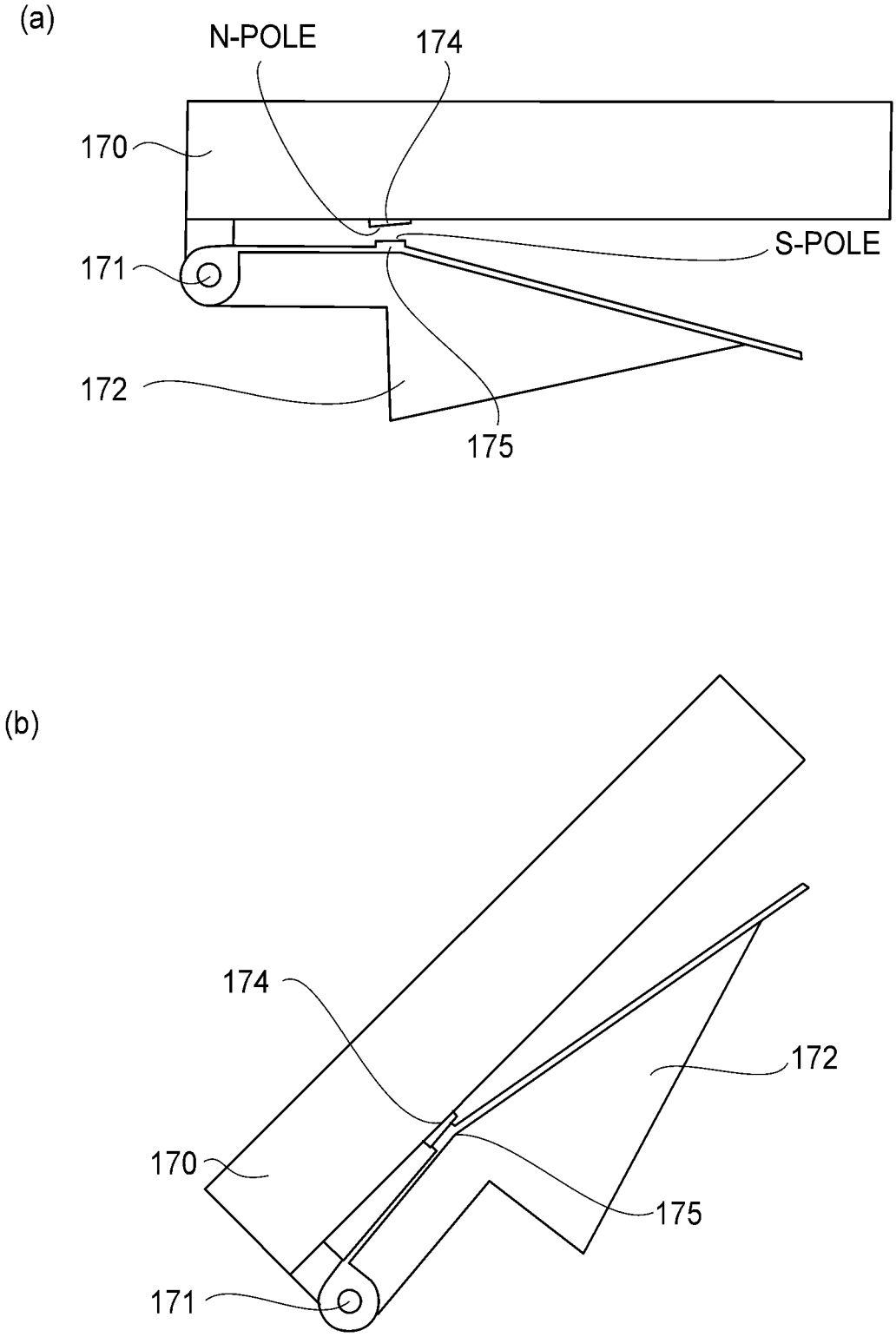
FIGS. 7(*a*) and 7(*b*) are schematic views for illustrating rotation of a scanner portion and a door in a conventional image forming apparatus.

Here, in the conventional image forming apparatus shown in FIGS. 7(*a*) and 7(*b*), when the above operations are performed, the following specific problem arises. The locking member (magnet 174) for holding the door 172 in the open state is provided on the image reading portion 170 rotatable about the rotation center shaft coaxial with the rotation center shaft of the door 172. For this reason, even when the image reading portion 170 is in any state (closed state, open state, etc.), the door 177 is locked (held to prevent the door 172 from rotating so as not to be closed). On the other hand, the image reading portion 170 is locked with respect to the image forming portion in the open state in which the image reading portion is completely opened. For that reason, when the door 172 is locked by the image reading portion 170 in a state in which the image reading portion 170 is partly opened, there is a possibility that the door 172 and the image reading portion 170 are accidentally closed during the access to the image forming portion. Further, in the case where a safety device for being stopped when the door 172 is opened is provided, in order to release the safety device, there is the need to perform an operation for confirming whether or not the door 172 is closed with reliability. Here, in the state in which the image reading portion 172 is closed, it is difficult to judge the open closed state of the door 172. However, the door 172 can be locked by the image reading portion 170 even when the image reading portion 170 is in the closed state, so that the operation for confirming the open/closed state of the door 172 by taking the trouble to open the image reading portion 170 is required, thus resulting in a problem in terms of operativity and convenience. In order to eliminate such an operation, it can be considered that a constitution in which the door is also closed with reliability when the image reading portion is closed in the locked state of the door is employed but it can be difficult to apply such a constitution due to the apparatus constitution.

First, an operation for raising the door 10 in the closed state of the scanner portion 3 when the inside of the printer portion 2 is exposed in the image forming apparatus 1 in Embodiment 1 of the present invention will be described. When the end of the door 10 opposite from the door rotation supporting portion 41 side is raised, the door 10 is rotated about the rotation center shaft A in the direction W, so that the abutment surface 47 of the door 10 contacts the abutment surface 46 of the scanner portion 3. When the door 10 is further raised, the abutment with surface 46 of the scanner portion 3 is pushed by the door 10 from below and therefore the scanner portion 3 is rotated about the rotation center shaft A in the direction W. As shown in FIG. 5C, in the state in which the abutment surfaces 46 and 47 of the scanner portion 3 and the door 10 abut against each other, when the door 10 is further rotated in the direction W by the predetermined amount (angle), the scanner portion 3 is held in the open state by the link member as described above. At this time, the locus 45 of the projection 31 of the lower link 22 is a locus rotating about the lower link rotating supporting portion 25 as the rotation center, thus passing below the surface 40 of the projection 23 of the door 10. Then, after the scanner portion 3 is held in the open state by the link member, when the user releases his (her) hand from the door 10, the door 10 rotates about the rotation center shaft A in the direction Z by the force applied by the self weight of the door 10. Then, the surface 39 of the door 10 contacts the surface 36 of the lower link 22, so that the door 10 is prevented from rotating in the closing direction and is held in the open state.

As described above, also in the case where the door 10 is raised in the closed state of the scanner portion 3, both of the scanner portion 3 and the door 10 are held in their open states.

Next, with reference to FIG. 5D, an operation for closing the scanner portion 3 while holding the door 10 in the open state when the image forming apparatus 1 is returned to the normal operation state will be described. As shown in FIG. 5D, when the end of the scanner portion 3 opposite from the scanner rotation supporting portion 20 side is pushed down, the scanner portion 3 is rotated about the rotation center shaft A in the direction Z, so that the projection 31 of the lower link 22 moves in a direction indicated by an arrow U along the locus 45. For that reason, the door 10 is pushed up at the surface 39 of the projection 32 by the surface 36 of the projection 31 of the lower link 22 by an overlapping amount 47. Then, the projection 31 of the lower link 22 moves along the locus 45 in the direction U while its state 37 contacts (slides on) the surface 40 of the projection 32 of the door 10. At the time when the surface 37 has passed under the surface 40, the door 10 is not held by any portion and is placed in a state in which the prevention of the rotation of the door 10 in the closing direction is released, so that the door 10 is rotated about the rotation center shaft A in the direction Z by its self weight and is closed. The scanner portion 3 is also similarly rotated about the rotation center shaft A in the direction Z and is closed. Incidentally, the gap 49 between the abutment surfaces of the door 10 and the scanner portion 3 when both of the door 10 and the scanner portion 3 are closed is set at a value larger than the overlapping amount 48 by which the door gets over the lower link.

As described above, also in the case where the scanner portion 3 is closed while the door 10 is held in the open state, it is possible to close both of the scanner portion 3 and the door 10.

As shown in this embodiment, with respect to the projection 31 of the lower link 22 for holding the door 10, the lower link rotation supporting portion 25 as the rotation center is located at the position different from the position of the door rotation supporting portion 41 as the rotation center of the projection 32 of the door 10, so that their rotation center axes are deviated from each other. As a result, the loci 43 and 45 can be set so that the positions of the projections 31 and 32 are separated from each other when the scanner portion 3 and the door 10 are in the closed state and intersect each other when the scanner portion 3 and the door 10 are in the open state, as shown in FIG. 5E. Therefore, only in the state in which the scanner portion 3 is in the open state, the holding of the door 10 can be performed by the projection 31 of the lower link 22. When the scanner portion 3 is closed or in an intermediate state in which the state of the scanner portion 3 is shifted from the closed state to the open state, the positions of the projection 31 of the lower link 22 and the projection 32 of the door 10 are separated from each other, so that the surface 39 of the projection 32 of the door 10 is not held by the surface 36 of the projection 31 of the lower link 22. In this way, in this embodiment, the number of the point of intersection between the movement loci of the center points of the surface 36 of the projection 31 of the lower link 22 and the surface 39 of the projection 32 of the door 10 is one.

Further, when the door 10 is held in the open state, the force applied from the door 10 to the lower link 22 is directed in the open direction of the scanner portion 3, so that there is no possibility that the door 10 is closed by the operation for holding the door 10. Further, in this embodiment, the scanner rotation supporting portion 20 and the door rotation supporting portion 31 constitute the rotation center shaft A but they are not always coaxially disposed with each other.

In this embodiment, when the scanner portion 3 is in the closed state or is not in the holding state by being partly opened, the door 10 is not held but is returned to the closed state by its own weight. That is, the door 10 is not held until the scanner portion 3 is in the holding state. Therefore, judgment that the door 10 is in the holding state or the closed state is easy. As a result, there is no need to concern a possibility that the scanner portion 3 and the door 10 are accidentally closed during the access to the inside of the printer portion 2 or whether or not the door 10 is completely closed in the closed state of the scanner portion 3. Therefore, the operativity during the access to the inside of the printer portion 2 is improved. Further, the user can concentrate his (her) attention on the center with respect to the inside of the printer portion 2, so that the convenience is improved. That is, accessibility to the inside of the image forming portion is improved.

Here, in this embodiment, the projection 31 is movable along the locus about the rotation center axis deviated from the rotation center axis of the door 10 in interrelation with the opening and closing operation of the scanner portion 3 and constitutes the holding portion capable of generating the force exerted in the direction in which the door 10 is opened. Further, the holding means capable of holding the scanner portion 3 and the door 10 at the predetermined open positions includes the projections 31 and 32 as the holding portion capable of mutually locking the door 10 and the link member 5. Further, in this embodiment, the link member 5 is constituted by the two links but may also be constituted by three or more links. Alternatively, the link member 5 may also be a known link mechanism such as a slider or a slider link. Further, the link member 5 may also be a link mechanism capable of permitting selection of a plurality of opening angles of the scanner portion 3 with respect to the printer portion 2. Also in this case, the link mechanism is only required that the door 10 can be held in the state in which the scanner portion 3 is held at any of the opening angles and that the holding of the door 10 is released by moving the scanner portion 3 in the closing direction while the user holds the scanner portion 3. Further, the link member 5 may also be such a device that there is no mechanism for holding the scanner portion 3, such as the link mechanism, and the scanner portion 3 is held in the closed state by pushing the scanner portion 3 by the user. In this case, the device is only required that the door 10 can be held by the scanner portion 3 in the open state of the scanner portion 3 and that the holding of the door 10 is released by moving the scanner portion 3 in the closing direction. Further, the link member 5 may also employ such a constitution that the scanner portion 3 is not rotated but is slid upward or backward while keeping the state in which the scanner portion 3 is parallel to the image forming portion.

[Embodiment 2]

Figure 6:
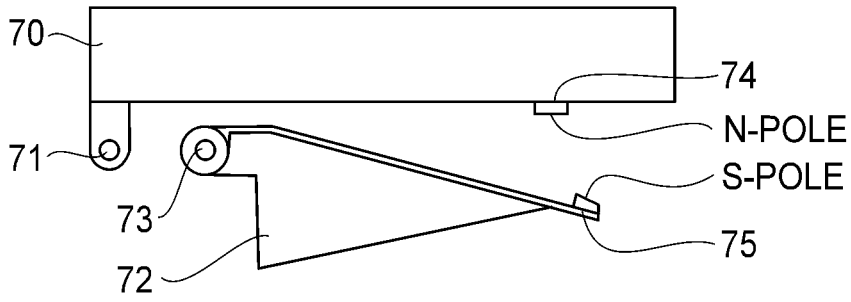
FIGS. 6(*a*) and 6(*b*) are schematic views for illustrating rotation of a scanner portion and a door in an image forming apparatus in Embodiment 2.
Figure 6:
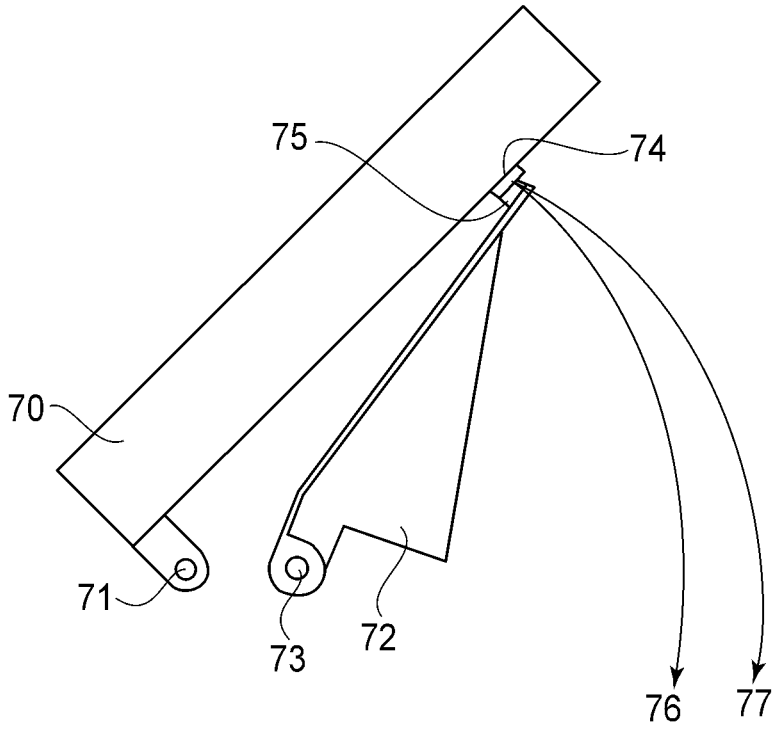

An image forming apparatus in this embodiment according to the present invention will be described with reference to FIGS. 6(*a*) and 6(*b*). FIGS. 6(*a*) and 6(*b*) are schematic views for illustrating the opening and closing operation of the scanner portion in the image forming apparatus in this embodiment, wherein FIG. 6(*a*) shows a state in which the scanner portion is closed and FIG. 6(*b*) shows a state in which the scanner portion is opened. In FIGS. 6(*a*) and 6(*b*), only a characterizing portion of the image forming apparatus is shown and other constitution and functions of the image forming apparatus are identical to those of the image forming apparatus in Embodiment 1, thus being omitted from description.

In this embodiment, a scanner rotation supporting portion 71 as the rotation center of a scanner portion 70 and a door rotation supporting portion 73 as the rotation center of a door 72 are not coaxial with each other, sot that two rotation center axes are deviated from each other. Further, magnets 74 and 75 are used for holding the door 72 in the open state. The magnets 74 and 75 are provided on the scanner portion 70 and the door 72, respectively, at positions in which the scanner portion 70 and the door 72 contact each other when they are in the open state. The magnet 74 on the scanner portion 3 side has an N-pole and the magnet 75 on the door 72 side has an S-pole, and those magnets 74 and 75 provide a pair of the N-pole and the S-pole and are disposed so that their contactable surfaces attract each other. A rotation locus 76 of the magnet 74 on the scanner portion 70 side and a rotation locus 77 of the magnet 75 on the door 70 side can be set in the following manner by deviating the rotation centers of the scanner portion 70 and the door 72 from each other. That is, the loci 76 and 77 can be set so that the positions of the magnets 74 and 75 are separated from each other when both of the scanner portion 70 and the door 72 are closed and so that the magnets 74 and 75 contact each other when both of the scanner portion 70 and the door 72 are in the open state. Therefore, when the scanner portion 70 is in the open state, the holding of the door 72 can be performed by the magnets 74 and 75. When the scanner portion 70 is closed or in the intermediary state in which the state of the scanner portion 70 is shifted from the closed state to the open state, the positions of the magnet 74 on the scanner portion 70 and the magnet 75 on the door 72 are separated from each other, so that the holding of the door 72 by magnetic force is not performed. When the user holds the scanner portion 70 and rotates the scanner portion 70 in the closing direction from a state in which the scanner portion 70 holds the door 72 in the open state, the door 72 can be partly rotated while being held by the scanner portion 70 depending on a contact area between the magnets 74 and 75. In this case, the door 72 is rotated by a predetermined angle in the state in which the door 72 is held by the scanner portion 70 but cannot be rotated freely in the closing direction with in the range of the predetermined angle, so that the door 72 is prevented from closing. One of the magnets 74 and 75 may also be a member formed of a magnetic material such as an iron.

Further, it is also possible to employ a constitution in which the magnet 75 is formed of the magnetic material and the magnet 74 is an electromagnet capable of generating the magnetic force only when a predetermined voltage is applied to the magnet 74, and the magnetic force is generated by applying the voltage to the magnet 74 only when the scanner portion 70 is opened with a predetermined angle or more. In this case, the scanner rotation supporting portion 71 and the position rotation supporting portion 73 may also be disposed coaxially with each other to cause no deviation between the rotation loci of the magnets 74 and 75. Further, in place of the constitution in which the voltage is applied to the magnet 74 only when the scanner portion 70 is opened with the predetermined angle or more, a constitution in which the voltage is applied when the scanner portion 70 is opened and then after the lapse of a predetermined time, the application of the voltage is stopped may also be employed.

Further, in this embodiment, the holding of the scanner portion 70 is performed by a link mechanism (not shown) as the holding means similarly as in Embodiment 1. However, as the holding means, the link mechanism is not particularly limited but may also be a known means so long as it can hold the scanner portion 70 in a predetermined open state (open position).

By the above constitutions, also in this embodiment, it is possible to achieve the same effect as that obtained in Embodiment 1.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 141082/2009 filed Jun. 12, 2009, which is hereby incorporated by reference.

What is claimed is:

1. An image forming apparatus comprising:

an image forming portion for forming an image on a recording material;

an image reading portion, for reading an original image, movable between a first position and a second position in which said image reading portion is away from said image forming portion relative to the first position;

an openable member movable between an open position in which said openable member exposes an inside of said image forming portion and a closed position in which said openable member covers said image forming portion; and a supporting portion configured to support said openable member to prevent said openable member from moving from the open position to the closed position when said image reading portion is located at the second position, wherein the image reading portion is movable from the first position to the second position in a state in which the openable member is located as it is in the closed position, wherein in a state in which the image reading portion is located in the second position, when the openable member is moved from the closed position to the open position, the openable member is supported by the supporting portion, wherein in a state in which the openable member is supported by the supporting portion, when said image reading portion is moved from the second position to the first position, the supporting portion is moved from a position in which the openable member is supported to a position in which the openable member is not supported, and the openable member is moved to the closed position.

2. An apparatus according to claim 1, further comprising:

a supported portion supported by said supporting portion, said supported portion being provided on said openable member, wherein the supported portion contacts the supporting portion to prevent the movement of said openable member toward the closed position, and wherein when said image reading portion is moved from the second position toward the first position, the supporting portion and the supported portion are separated from each other before said image reading portion reaches the first position.

3. An apparatus according to claim 1, wherein said supporting portion prevents said openable member from moving from the open position toward the closed position only when said image reading portion is located at the second position.

4. An apparatus according to claim 2, wherein an intersection point of a locus of the movement of said supporting portion in interrelation with the movement of said image reading portion between the first position and the second position and a locus of the movement of the supported portion in interrelation with the movement of said openable member between the open position and the closed position is one, and wherein the supporting portion is located at the intersection point when said image reading portion is located at the second position.

5. An apparatus according to claim 2, wherein said image reading portion and said openable member are rotationally moved relative to said image forming portion, wherein said image forming apparatus further comprises a link member, provided so as to connect said image forming portion and said image reading portion, movable in interrelation with the rotational movement of said image reading portion, and wherein the supporting portion is a first projection provided on the link member and the supported portion is a second projection provided on the openable member.

6. An apparatus according to claim 5, wherein in a state in which said supporting portion supports said openable member when said image reading portion is located at the second position, the second projection receives a force, from the first projection, for rotationally moving said openable member in a direction opposite to the direction from the open position toward the closed position and the first projection receives a force, from the second projection, for rotationally moving said image reading portion in a direction opposite to the direction from the second position toward the first position.

7. An apparatus according to claim 2, wherein said image reading portion and said openable member are rotationally moved relative to said image forming portion, and wherein a rotation shaft of said image reading portion is different from a rotation shaft of said openable member.

8. An apparatus according to claim 7, wherein the supporting portion is provided on said image reading portion and the supported portion is provided on said openable member, and wherein the supporting portion and the supported portion are attraction members for permitting attraction each other and prevent the rotational movement of said openable member from the open position to the closed position by mutual attraction and contact.

9. An apparatus according to claim 1, wherein a space which at the closed position is located between said openable member and said image reading portion is a recording material discharge space in which a recording material is to be discharged from said image forming portion, and wherein the recording material discharge space is enlargeable by moving said image reading portion from the first position to the second position.

* * * * *